United States Patent [19]

Fuchs

[11] Patent Number: 4,461,361

[45] Date of Patent: Jul. 24, 1984

[54] UNDERREAMER WITH CYLINDRICAL BOSS AND SOCKET HINGE ASSEMBLY FOR THE CUTTER ARM

[75] Inventor: Benjamin H. Fuchs, Long Beach, Calif.

[73] Assignee: Dresser Industries, Inc., Dallas, Tex.

[21] Appl. No.: 327,981

[22] Filed: Dec. 7, 1981

[51] Int. Cl.[3] ..... E21B 10/32

[52] U.S. Cl. ..... 175/269

[58] Field of Search ..... 175/267, 268, 269, 279, 175/280, 284, 285, 286, 287, 288, 289; 16/350, 351, 386, 223

[56] References Cited

U.S. PATENT DOCUMENTS

| | | | |
|---|---|---|---|
| 3,233,277 | 2/1966 | Hirashiki | 16/386 |
| 3,425,500 | 2/1969 | Fuchs | 175/269 |
| 3,483,934 | 12/1969 | Fuchs | 175/267 |
| 3,749,187 | 7/1973 | Leathers | 175/269 |
| 3,750,771 | 8/1973 | Cugini | 175/269 |
| 4,187,920 | 2/1980 | Johnson | 175/267 |
| 4,190,124 | 2/1980 | Terry | 175/325 |
| 4,282,941 | 8/1981 | Perkin | 175/267 |
| 4,282,942 | 8/1981 | Longmore | 175/269 |

*Primary Examiner*—James A. Leppink
*Assistant Examiner*—Joseph Falk
*Attorney, Agent, or Firm*—Fred A. Winans

[57] ABSTRACT

An underreamer having a plurality of drilling arms hingedly attached to a tubular body for movement between a retracted position and an extended position for drilling. The hinge attachment includes a cylindrical boss and socket assembly, between the arm and a removeable hinge plate retained in a recess in the body against outward movement by an engaging key and keyway between the plate and wall of the recess.

6 Claims, 4 Drawing Figures

UNDERREAMER WITH CYLINDRICAL BOSS AND SOCKET HINGE ASSEMBLY FOR THE CUTTER ARM

BACKGROUND OF THE INVENTION

1. Field of the Invention

This invention relates to an earth boring tool commonly known as an underreamer and, more particularly, to a hinge assembly for attaching the cutter arms to the tubular body.

2. Brief Description of the Prior Art

Underreamers are well known tools used in the well drilling art to enlarge portions of a borehole in oil and gas wells for various purposes. The underreamer generally comprises a tubular body having a pilot cutter or reaming lugs at one end and threaded means at the opposite end for connection to a drill string. The tubular body includes a plurality of axially elongated cavities. An elongated cutter arm is housed within each cavity with the lower end of the arm suppporting a rotating cone cutter and the opposite end hinged to the body through a hinge pin inserted transversely through the body and the upper end of the arm for rotational movement from within the cavity to an extended position wherein the cutter is effective to contact the wall of the borehole and enlarge it.

The tool also includes an axially moveable central wash pipe in fluid flow communication with the drilling mud for circulating mud to the borehole to flush the cuttings therefrom. The washpipe normally includes a piston, having a limited size opening therethrough, in sliding sealing engagement with the central axial bore of the tubular body, and a pipe portion extending therefrom with a jet nozzle at its lower end for jetting the drilling fluid therefrom. A cam member defining a plurality of cam lobes is attached to the pipe adjacent the lower end thereof with each lobe in alignmet with cam follower surfaces defined on the back faces of the hinged arms so that as the wash pipe moves axially downwardly under the influence of an increase in pressure of the drilling fluid on the face of the piston, the cam lobes contact the surfaces and force the arms from a retracted position generally flush with the surface of the tubular body, to the full extended position.

A spring member is disposed below the piston and a lower shoulder in the internal bore of the body and normally biases the piston to its axially upward position corresponding to the cam lobes permitting the arms to be in the retracted position. Thus, when the underreamer operation is completed, the mud pressure is reduced to normal to permit the spring to return the piston to this position. In such position the arms are permitted to return to the retracted position under their own weight.

However, it can be appreciated, that with the arms enlarging the borehole, the circulating drilling mud in the vicinity of the arms does not necessarily flow past the extended arms and cutters with sufficient velocity and controlled flow pattern to insure that the cuttings will be removed from between the extended arms and the body or from the arm cavities and hinge area. As a matter of fact, it is the general experience that, without some special fluid flow path for flushing this specific area, it is not uncommon for the cuttings to prevent the full retraction of the arms. Further, during withdrawal of the tool from the borehole, it is not always apparent to the drilling personnel that the arms are not retracted to the flush position and thus, the extended arms, upon withdrawal engage the borehole as it is being withdrawn through the portion that was not underreamed.

It is thus readily apparent that upon retracting the tool from the borehole, as the downwardly outwardly extending arms contact the narrow portion of the borehole, the upward withdrawing force places considerable force on the arms to retract them to the flush position. However, if cuttings such as compacted gumbo or rock fragments interfere with the closing, this force is transmitted to the hinge pin and multiplied by the leverage of the arm about the obstruction. This in turn has resulted in the damage and total destruction of the hinge pin, and can even cause loss of the arm downhole.

SUMMARY OF THE PRESENT INVENTION

The present invention provides an underreamer of the general description as above however with a hinge assembly capable of withstanding substantial force without damage. Thus, as opposed to the conventional method of attachment of the arms through a hinge pin, the present invention provides a cylindrical boss, having an axis perpendicular to the plane of hinged movement of the arm, at the hinged end of the arm. The boss is received in a matching cylindrical socket in an arm hinge plate. The hinge plate has an outwardly extending key on a side thereof mating with a groove in the side of a complimentary recess in the tool body for retention against outward forces. To assemble, the arm boss is placed in the socket of the plate and the plate is axially slid into seated engagement within the slotted recess. A pair of cap screws retain the plate therein against axial displacement. With this arrangement, a greater hinge surface area is provided which is better capable of withstanding the forces encountered when the arms are forced closed by the sidewalls of the borehole and which better resist the fretting and torque loads imposed thereon during normal underreaming operations. Further, the outward force on the hinge plate during such forced closings of the arm is transmitted to the body in the keyway of the plate so that the force on the cap screws is not appreciably increased. Another advantage over the conventional hinge pin arrangement is that less stock is removed from the reamer body (i.e. the transverse pin holes are no longer present through the body) resulting in a stronger tool.

DESCRIPTION OF THE PREFERRED EMBODIMENT

Figure 1:
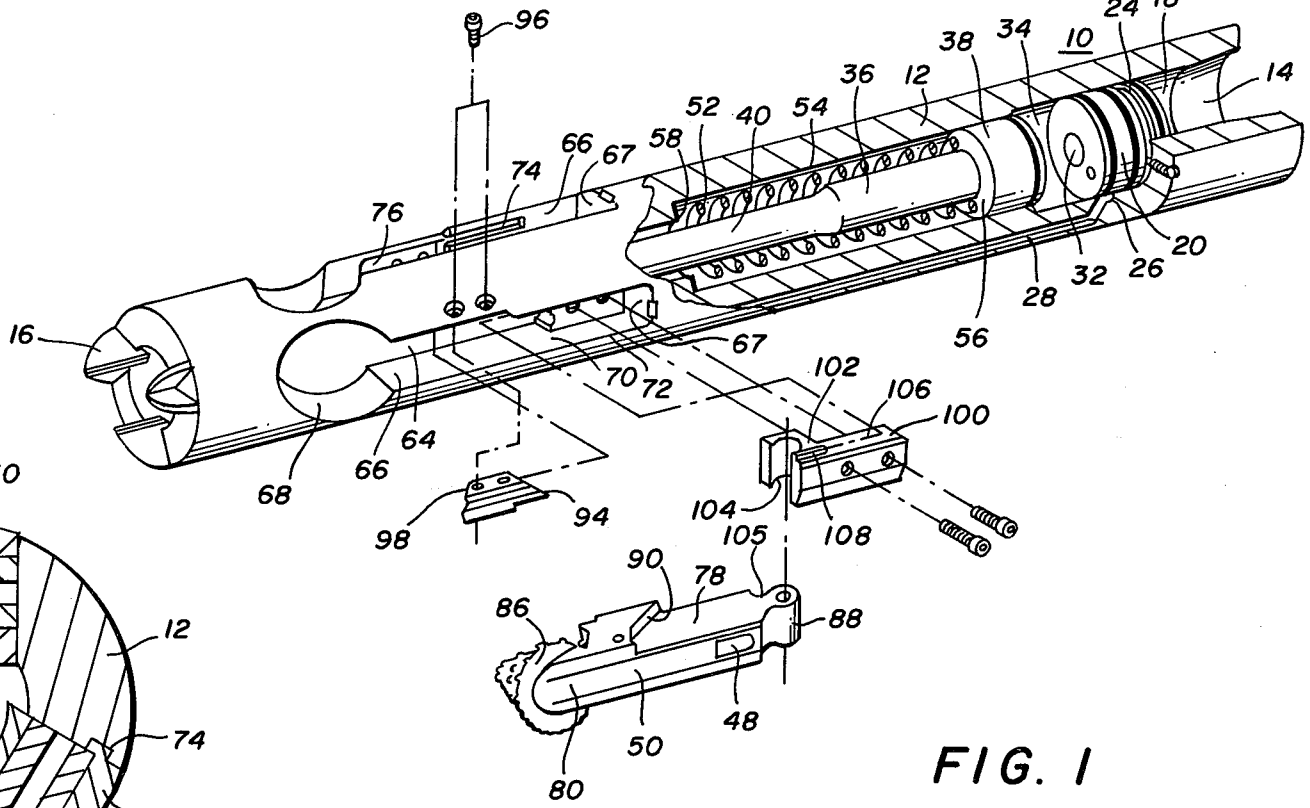
FIG. 1 is an exploded isometric view, with parts broken away, of an underreamer according to the present invention.

Referring initially to FIG. 1, an underreamer tool 10 is shown as comprising a tubular body 12 having an upper internally threaded box portion 14 and a lower end having a pilot earth-boring cutter element 16 such as reaming lugs projecting therefrom.

The body 12 has an axial bore throughout its length, which bore is sectioned into separate axial portions including an upper cylinder portion 18 housing a valving piston 20 which is, under normal conditions, stationarily retained therein by a shear pin 22 extending through the body wall into a circumferential groove 24 in the piston. The piston 20 sealingly engages the bore wall and normally blocks an inlet port 26 leading to a flow channel 28 in the tool wall and extending therefrom to an outlet port 30 (see FIG. 2) in the bore above the hinged arms, described later herein.

It is to be understood that a plurality of such inlet ports 26, channels 28, and outlet ports 30 are provided, although only one is shown.

The valving piston 20 defines a large opening 32 axially therethrough for delivering drilling fluid pumped through the drill string into bore chamber 34 immediately above an axially moveable wash pipe 36 disposed in the bore. The wash pipe 36 includes a piston 38 at the upper end, and a pipe portion 40 terminating in a jet nozzle 42 (again see FIG. 2).

Figure 2:
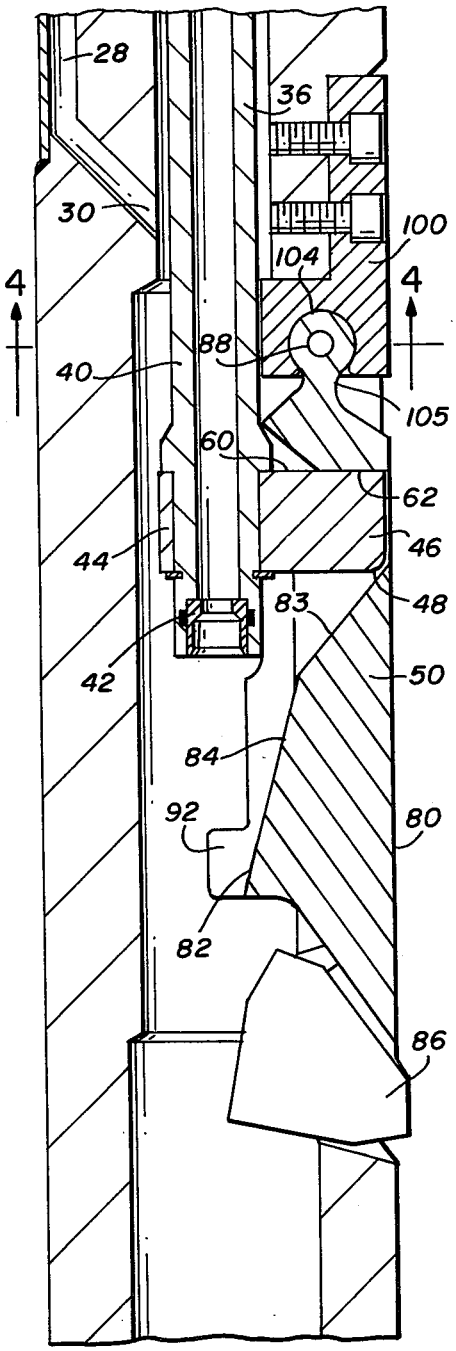
FIG. 2 is an axial cross-sectional view of the portion of the underreamer showing a hinged arm in a retracted position.

Referring to FIG. 2, it is seen that a cam member 44 is mounted on the lower end of wash pipe 36 and defines a plurality of cam lobes 46 (only one being shown) projecting radially therefrom and nesting in an appropriate cavity 48 in a hinged cutter arm 50 when the arm is in a retracted position.

Referring again to FIG. 1, a coil spring 52 is enclosed in an intermediate portion 54 of the bore and encircles the wash pipe, engaging the under-surface 56 of the piston 38 and a shoulder 58 in the bore to bias the wash pipe to an upper position in which the upper surface 60 of cam lobe 46 engages a complimentary upper surface 62 of the arm cavity 48 (as shown in FIG. 2).

The lower end of the tubular body 12 defines a plurality of axially elongated cavities or openings 64 (preferably three such openings are provided, but only two are shown in FIG. 1) equangularly disposed therein and extending completely through the wall. The openings are generally defined by parallel facing axially disposed sidewalls 66, terminating at their lower end in an enlarged circular opening 68 and at the opposite or upper end in a recess 70 having a planar bottom wall 72. At least one sidewall 66 has an axial keyway 74 slotted therein generally sub-adjacent the recess 70 and a notch 76 immediately below the keyway for receipt therein of a stop member 94 to be discussed later.

A cutter arm 50 is disposed in each elongated opening 64 and, as shown in FIG. 1, defines an axially elongated substantially rectangular member having opposite sidewalls 78, a front face 80 and a rear surface 82 (see FIG. 2) defining camming surfaces 83, 84. A rotary cone cutter 86 is mounted on a bearing pin (not shown) extending from the lower end thereof. The opposite or upper end of the arm 50 is configured to define a cylindrical arm boss 88 having an axis generally perpendicular to the axis of the tubular body 12 and connected to the main body of the arm through a reduced thickness neck 105. The boss 88 is inset from the surface 80 of the arm and extends completely across the width of the arm 50.

The opposite sides 78 of the cutter arm 50 define an outwardly projecting diagonally extending shoulder 90 and a rearwardly extending tab member 92 (see FIG. 2) respectively. Shoulder 90 abuts an arm stop plate 94 configured to nest within the notch 76 and removably retained therein by cap screws 96 extending through apertures in the body, and defining a stop surface 98 for facing contact with the shoulder 90 when the arm is in the full extended position illustrated in FIG. 3.

An arm hinge plate 100 is configured to be nested within recess 70 in general abutting engagement with the sidewalls 66 and topwall 67 thereof and defines an inwardly extending foot portion 102 having a cylindrical socket 104 extending therethrough, open on the bottom end to permit the neck portion 105 of the cutter arm to extend therethrough when the cylindrical boss is disposed within the socket. One sidewall 106 of the plate 100 defines a key 108 projecting therefrom for mating, sliding engagement in the keyway 76 in the sidewall 66 of the opening 64. A pair of cap screws 110 extend through appropriate apertures in the plate 100 into the threaded openings in the bottom surface 72 of the recess 70.

Thus, as shown by dotted lines in FIG. 1, assembly of the cutter arm 50 to the underreamer body first requires insertion of the cylindrical boss 88 of the arm 50 into the matching cylindrical socket 104 of plate 100. The plate is then placed in the opening 64 in alignment with and axially below the recess 70 and moved axially upwardly into abutting engagement with top wall 67 within the recess and to engage the key 108 in the keyway 74. The plate is axially retained therein by the screws 110. The arm is then disposed in the retracted position and the arm stops 94 are inserted into notch 76 and retained therein by the screws. As such, the cutter arm 50 is hinged by the mating cylindrical boss and socket 88, 104 arrangement for movement between an extended position as limited by engagement of the shoulder 90 with the arm stop shoulder 98 and a retracted position wherein the surface of the arm is generally flush with the surface of the tubular body. In the extended position of the cutter arm 50, the tab member 92 projects rearwardly sufficient to engage a sidewall 66 of opening 64 to transmit the rotary movement of the body to the arm therethrough.

Figure 3:
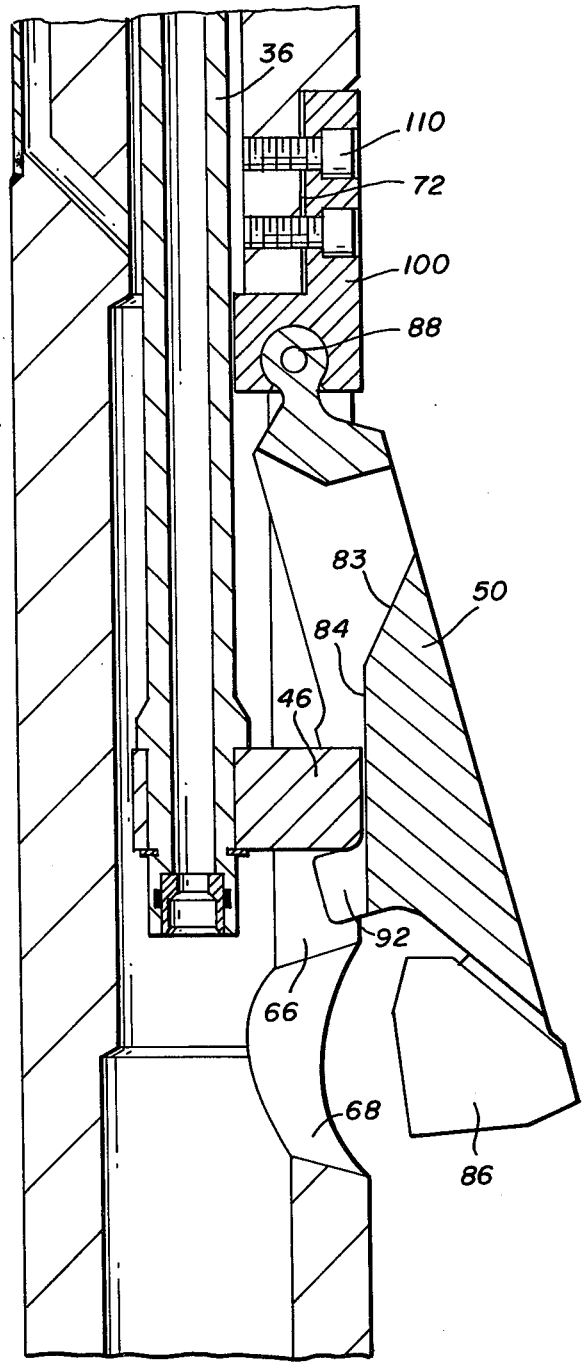
FIG. 3 is a view similar to FIG. 2 showing a hinged arm in extended position.

Referring to FIGS. 2 and 3, the arm 50 is shown in retracted (FIG. 2) and extended (FIG. 3) position. The transition from retracted to extended position during drilling operations is gradual in that the diameter of the borehole being enlarged is generally only slightly larger than the diameter of the tubular body member. Thus, under increased drilling mud pressure, the wash pipe 36 is forced axially downwardly causing lobe 46 to contact cam surface 83 of the arm urging the arm outwardly. As wall disintegration occurs, during rotation of the tool, both outwardly and downwardly, the borehole is enlarged by a tapered wall until the arms 50 reach their fully extended position, and thereafter the borehole is enlarged to this constant extended diameter. As can be appreciated, during this transition period, with the cams forcing the arms outwardly and with the walls resisting such force, a considerable outward force is placed on the hinged boss 88 and socket 104 assembly. However, even larger forces on these members can be encountered should, during drilling operations, rock chips or compacted or balled earth material become lodged between the extended arms 50 and the tubular body 12 in a manner that prevents full retraction of the arms to the flush position required for removing a tool from the borehole. Under such conditions, the wash pipe 36 is spring biased to its upper position as the mud pressure is reduced, so that the lobe 46 is in alignment with cavity 48. Upon withdrawal of the tool, the extended arms contact the tapered walls of the borehole to assist in forcing the arms to the retracted position. However, if retraction is prevented as above described, the force between the borehole walls and the arms as the tool continues to be withdrawn, places a substantial force in the hinge boss 88 and socket 104 assembly. Thus, the enlarged boss and socket assembly of the present invention provides an enlarged surface area capable of withstanding this force without damage or failure.

Figure 4:
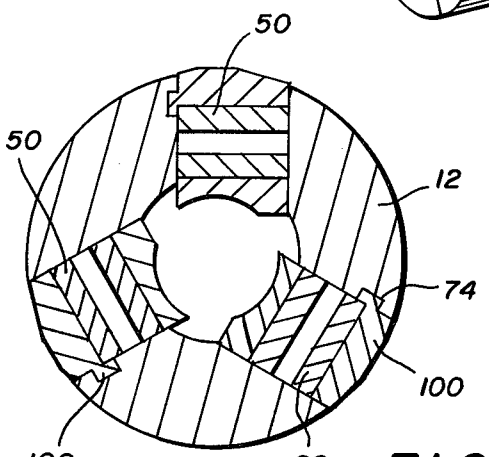
FIG. 4 is a cross-sectional view generally along lines IV—IV of FIG. 2.

Further, with reference to FIG. 4, in addition to illustrating the three equangularly disposed positions of the arms, it is apparent that any outwardly directed forces on the hinge plate 100 are transmitted to the tool body 12 through the key 108 and mating keyway 74 so that the cap screws 110 primarily function to retain the plate 50 against downwardly axial forces, which forces are non-existant during drilling operation and minimal during withdrawal of the tool.

Thus with this arrangement, a much stronger and more reliable hinge assembly is provided which is readily assembled and disassembled in the field.

I claim:

1. An underreamer tool for enlarging an earth borehole, said tool comprising a tubular body having means for driving connection with a drill string; a plurality of cutter arms, including a cutter element, attached to said body by hinge means for movement between a retracted position wherein each arm and cutter element is disposed within an appropriately sized opening in said body and an outwardly extended position wherein said cutter element engages the borehole, said hinge means comprising:

a hinge plate disposed in a recess in said body adjacent the upper end of said opening and defining a lower terminal end extending into said opening;

the upper end of said arm and the lower terminal end of said plate defining cooperating cylindrical boss and socket engagement members with the axis of said cylindrical boss and socket of said members perpendicular to the plane of the hinged movement of the arm and: said socket member defining a cylindrical bore open along one side with the width of said opening being less than the diameter of said socket; and, a substantially cylindrical boss member of generally common radius and having a diameter greater than the width of said opening to provide a relatively large area of engagement between said engaged boss and socket member, with said boss member terminating in an integral reduced thickness area defining a neck portion projecting through said opening, said neck portion having a thickness less than the width of said opening to permit free hinged movement of said boss in said socket whereby all forces on said hinge means are supported at said large area of engagement between the cylindrical socket member and the cylindrical boss member; and, means for retaining said plate within said recess.

2. The structure according to claim 1 wherein said cylindrical socket member comprises said lower terminal end of said plate member and open to said opening in said body and said arm defines said cylindrical boss member,

3. Structure according to claim 1 wherein said arm and plate are of a substantially common width dimension as measured parallel to the axis of a hinged motion and said boss and socket extend across said dimension.

4. Structure according to claim 3 wherein said plate has opposed sidewalls, a top wall and front and rear surfaces and wherein said walls are in close facing association with mating walls in said recess and said rear surface engages a facing surface of said recess for seating said plate within said recess with said front surface generally flush with the surface of said body.

5. Structure according to claim 4 wherein said retaining means includes cooperating engaging key and keyway means in at least one pair of facing sidewalls of said plate and cavity for retention against outward forces.

6. Structure of claim 5 wherein said retaining means also includes screw means extending through said plate and into said recess to retain said plate against axial displacement.

* * * * *